US010794674B2

(12) United States Patent
Parker et al.

(10) Patent No.: US 10,794,674 B2
(45) Date of Patent: Oct. 6, 2020

(54) ELECTRIC TRACER MUNITION

(71) Applicant: BAE SYSTEMS plc, London (GB)

(72) Inventors: Simon France Parker, Crewe Cheshire (GB); Joshua Matthew Stubbs, Crewe Cheshire (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 16/349,687

(22) PCT Filed: Nov. 13, 2017

(86) PCT No.: PCT/GB2017/053416
§ 371 (c)(1),
(2) Date: May 14, 2019

(87) PCT Pub. No.: WO2018/091873
PCT Pub. Date: May 24, 2018

(65) Prior Publication Data

US 2019/0368847 A1 Dec. 5, 2019

(30) Foreign Application Priority Data

| | | |
|---|---|---|
| Nov. 15, 2016 | (GB) | 1619313.8 |
| Jan. 12, 2017 | (EP) | 17151164 |
| Sep. 18, 2017 | (EP) | 17275143 |
| Sep. 18, 2017 | (GB) | 1714984.0 |

(51) Int. Cl.
*F42B 12/38* (2006.01)

(52) U.S. Cl.
CPC ..... *F42B 12/382* (2013.01)

(58) Field of Classification Search
CPC ..... F42B 12/382
See application file for complete search history.

(56) References Cited

U.S. PATENT DOCUMENTS

| | | | |
|---|---|---|---|
| 5,246,372 | A | 9/1993 | Campagnuolo et al. |
| 5,481,979 | A | 1/1996 | Walder |
| 7,259,692 | B1 | 8/2007 | Eichenberg |
| 8,113,689 | B2 | 2/2012 | Mayo et al. |

(Continued)

FOREIGN PATENT DOCUMENTS

| | | | |
|---|---|---|---|
| CN | 204705273 | U | 10/2015 |
| EP | 3023730 | A1 | 5/2016 |

(Continued)

OTHER PUBLICATIONS

International Search Report and Written Opinion received for PCT Application No. PCT/GB2017/053416. dated Feb. 15, 2018. 13 pages.

(Continued)

*Primary Examiner* — J. Woodrow Eldred
(74) *Attorney, Agent, or Firm* — Finch & Maloney PLLC

(57) ABSTRACT

There is disclosed a tracer munition. There is provided a tracer munition for selective activation, the tracer munition comprising: an electronic tracer device, said tracer munition comprising at least one cavity capable of receiving said electronic tracer device wherein the electronic tracer device comprises an electrical power source and an electronic emitter, whereupon selective activation of the electronic tracer device, said electronic emitter emits radiation.

20 Claims, 5 Drawing Sheets

(56) References Cited

U.S. PATENT DOCUMENTS

| | | | | |
|---|---|---|---|---|
| 2005/0034627 | A1 | 2/2005 | Manole et al. | |
| 2007/0273290 | A1 | 11/2007 | Ashdown et al. | |
| 2008/0216699 | A1 | 9/2008 | McAleer et al. | |
| 2010/0072895 | A1 | 3/2010 | Glynn et al. | |
| 2010/0285909 | A1 | 11/2010 | Voelker et al. | |
| 2016/0161232 | A1* | 6/2016 | Rubin | F42B 12/367 102/439 |
| 2016/0231090 | A1 | 8/2016 | Bishop et al. | |

FOREIGN PATENT DOCUMENTS

| | | | |
|---|---|---|---|
| EP | 3023731 | A1 | 5/2016 |
| KR | 20120116106 | A | 10/2012 |
| WO | 9941722 | | 8/1999 |
| WO | 2005019763 | A1 | 3/2005 |
| WO | 2014066917 | A1 | 5/2014 |
| WO | 2018091872 | A1 | 5/2018 |
| WO | 2018091873 | A1 | 5/2018 |

OTHER PUBLICATIONS

International Search Report and Written Opinion received for PCT Application No. PCT/GB2017/053415 dated Jan. 19, 2018. 14 pages.
GB Search Report under Section 17(5) received for GB Application No. 1619313.8, dated May 8, 2017. 5 pages.
GB Search Report under Section 17(6) received for GB Application No. 1619313.8, dated Aug. 30, 2017. 3 pages.
Partial EP Search Report received for EP Application No. 17151164.5, dated Jul. 11, 2017. 14 pages.
Extended EP Search Report received for EP Application No. 17151164.5, dated Oct. 25, 2017. 12 pages.
GB Search Report under Section 17(5) received for GB Application No. 1714984.0, dated Oct. 31, 2017. 3 pages.
Extended EP Search Report received for EP Application No. 17275143.0, dated Nov. 6, 2017. 8 pages.
International Preliminary Report on Patentability received for PCT Application No. PCT/GB2017/053416. dated May 31, 2019. 8 pages.
International Preliminary Report on Patentability received for PCT Application No. PCT/GB2017/053415. dated May 31, 2019. 8 pages.

* cited by examiner

ELECTRIC TRACER MUNITION

The present invention relates to a tracer munition, such as a tracer projectile, with an electronic tracer device, more specifically to a tracer bullet.

Conventional tracer munitions comprise a portion of an energetic material, typically a pyrotechnic formulation, which is ignited during the launch of the munition.

According to a first aspect of present invention there is provided a tracer munition for selective activation, the tracer munition comprising: an electronic tracer device, said tracer munition comprising at least one cavity capable of receiving said electronic tracer device wherein the electronic tracer device comprises an electrical power source and an electronic emitter, whereupon selective activation of the electronic tracer device, said electronic emitter emits electromagnetic radiation.

The tracer munition may preferably be a tracer bullet or a tracer shell.

The electronic emitter may preferably emit electromagnetic radiation across the visible light and/or IR spectrum. The electronic emitter may provide an output with more than one wavelength. The electronic emitter may provide multiple outputs at different parts of the EMF spectrum. The electronic emitter may provide light outputs and non-light outputs.

In a preferred arrangement the electronic emitter is a light emission unit, and may have a wavelength independently selected from the visible range and/or IR range. The light emission units may be any light source, preferably solid state light emitter, such as, for example, LED or laser diode.

In a highly preferred arrangement the electronic emitter is a light emitting diode. The LED or laser diode has a wavelength selected from the visible range and/or IR range. In one arrangement there may be an array, the array may comprise at least two different electronic emitters, preferably there may be at least two different LEDs or laser diodes and they may comprise different wavelength light emitting diodes or laser diode. The at least two LEDs or laser diodes may be independently selectable and independently activated.

LEDs provide the advantage of a greater selection of frequencies.

Laser diodes, due to their spectral and spatial coherent light, may provide detection of the entire duration of the flight, and may provide location and or targeting for further munitions to follow.

The electronic tracer device may be activated after launch of the munition. Preferably, the light emission unit may be activated after launch of the tracer munition.

In a conventional pyrotechnic tracer, the composition is typically pressed/consolidated into the cavity under high pressure, to ensure the pyrotechnic composition is retained in the cavity, as the munition experiences high g-force loads and high spin rates. Further the consolidation allows the correct burn performance and time to be achieved.

In a preferred arrangement there may be a retainer, to retain the electronic tracer device within the cavity. The retainer may be a mechanical fastener, or a chemical adhesive or potting compound or combination of both mechanical and chemical. The mechanical fastener may be a crimp, clamp or threaded engagement. The retainer may be reversible such as to allow the tracer device to be removed and replaced, without compromising the tracer munition.

The cavity for tracer munitions are typically rearward of the munition, and are typically initiated by the action of the hot gases/particles from the propellant's combustion. An electronic tracer device, may therefore be placed in any convenient location on the tracer projectile. However, in a highly preferred arrangement, the cavity comprising the electronic tracer device is located rearwardly of the munition. The electronic tracer device may be retrofitted to current tracer munitions, where the tracer composition has been extracted.

The light emission units, and particularly the LEDs or laser diodes may be arranged in the cavity, substantially flush with the end of the walls of the munition that define the cavity. Preferably the light emission unit is contained entirely within the existing cavity of the tracer munition, particularly for bullets were protrusions may affect the performance of the said bullet.

Alternatively the LEDs or laser diodes may be set below the outer surface to reduce the cone angle of the light. Where a wider cone angle of light output is desirable, the LED, laser diodes and/or light emission units may be flush or even protruding from the end of the walls of the cavity.

Preferably, there is a plurality of light emission units each connected to the electrical power source independently and said light emission units comprise the array of light emitting diodes, and a power converter unit for driving the array.

The device optionally further comprising an operator interface, a control unit independently connected to each light emission unit, the control unit comprising a processor and being operably connected to the operator interface.

In a preferred arrangement, there is provided an IR illumination tracer munition device for selective activation where upon activation the device emits IR radiation in the range of wavelengths of from 700 nm to 100 micrometers, more preferably of from 750 nm to 900 nm, the device comprising:

an electrical power source;

a plurality of light emission units each connected to the power source independently and said light emission units comprising:

an array of light emitting diodes or laser diodes, to emit light radiation;

a power converter unit for driving the array.

Further, the independent coupling of the control unit to each light emission unit, and the provision of a power converter at each light emission unit, tends to provide the device with redundancy in case a part fails in service.

The use of an LED or laser diode, allows for a light source which is not the product of a pyrotechnic reaction. Pyrotechnic compositions are hazardous, which introduces logistics problems of storage and handling.

A yet further issue is that due to decomposition of the pyrotechnic material in conventional tracer munitions, often due to moisture ingress, the conventional pyrotechnic compositions may have a reduced lifetime, depending on conditions of storage and transport.

The LEDs and laser diodes may be selected to provide very specific wavelengths, with narrow bandwidths. They have very low power consumption and may be easily integrated onto printed circuits as parts of larger systems.

The range of wavelengths may be independently selected in the near IR, mid IR or Far IR wavelength range. In one arrangement there is provided a first IR LED/laser diode with a first IR radiation wavelength, and a second IR LED/laser diode with a second different IR radiation wavelength.

The IR range may be selected from a wavelength of from 700 nm to 100 micrometers, mare preferably of from 750 nm to 900 nm.

In a further arrangement the array may comprises at least two different wavelength IR light emitting diodes. The IR light emitting diodes or laser diodes may be specifically selected to provide specific wavelengths to work with specific night vision optics. The array and therefore specific IR light emitting diodes or laser diodes may be selectively activated depending on the specific requirement.

The array may be any shape or arrangement, such as for example the LEDs or laser diodes may be arranged linearly, random, curved, patterned, within the device. The LEDs or laser diodes may be located on the surface or in recessed portions in a housing, to provide protection.

The LEDs or laser diodes may be further covered with a layer, coating or sheath to provide protection and/or ruggedness.

Each light emission unit may comprise a capacitive energy store and/or and inductive energy store and/or kinetic energy store, or combinations thereof. Such an energy store may be tuned to deliver power in a particularly responsive manner and so can therefore permit higher switching frequencies of the light emitting element arrays.

There may be provided a capacitor charging means electrically interposed between the power source and each capacitive energy store. The capacitor charging means may be connected to the control unit.

The control unit may be configured for driving at least one of the arrays of light emitting elements in a pulse mode when the device is activated such is that in operation the array of light emitting elements may switch between a high power output condition and a low power output condition repeatedly. The pulse mode may be such that the array of light emitting elements may switch between conditions at a predetermined frequency. The low power output mode may be substantially zero watts.

The power source may be any electrical power source, such as for example an electrical cell, fuel cell, capacitor, and combinations thereof.

The operator interface may be configured to enable selection between initiation modes. The initiation modes may comprise any combination of an instant initiation, a delayed initiation, a wirelessly controlled initiation, such as for example, RF, NFC, Bluetooth, or mechanical force, such as, for example from high-g forces from set-back, high spin rates, or high-g from rapid deceleration. For launched munitions, such as shells, under gun launched grenades, the munition may comprise a fuze, which may be set to determine the point of deployment of the payload comprising the device. The initiation may be detected using accelerometers to determine preset levels of force to ensure that the electronic tracer device only functions when the munition is deployed.

The operator interface may be configured to enable selection between activation modes. The activation modes, that is the emitted output may comprise: a pulse mode where the light emitting elements may switch between a high power output condition and a low power output condition repeatedly or a continuous power output mode where the power output is substantially constant. The pulse output may be used to provide a signal or basic communications, instructions, or facilitate location of the tracer munition.

The device may also further comprise at least one LED or laser diode or an array of LEDs/or laser diodes whose output is outside of the near IR and far to IR regions, such as for example the visible light region or UV.

According to a further aspect of the invention there is provided the use of an electronic tracer device in a tracer munition, wherein the electronic tracer device comprises an electrical power source; and a light emitting diode or laser diode.

According to a yet further aspect of the invention there is provided a tracer bullet for selective activation, the tracer bullet comprising an electronic tracer device, said tracer munition containing only one cavity capable of receiving said electronic tracer device, wherein the electronic tracer device is located only within the cavity of said bullet, such that is flush or recessed from the external profile of the cavity wall, wherein the electronic tracer device comprises an electrical power source and a light emitting diode or laser diode, whereupon selective activation of the electronic tracer device, said light emitting diode or laser diode emits light radiation.

According to a yet further aspect of the invention there is provided a method of following the trajectory path of a fired tracer munition, comprising the steps of I. firing a tracer munition comprising an electronic tracer device, as defined herein, II. causing activation of the electronic tracer device, said light emitting diode providing a spectral output, III. tracking the spectral output of the light emitting diode or laser diode.

So that the invention may be well understood, embodiments thereof shall now be described with reference to the following figures, of which:

Figure 1:
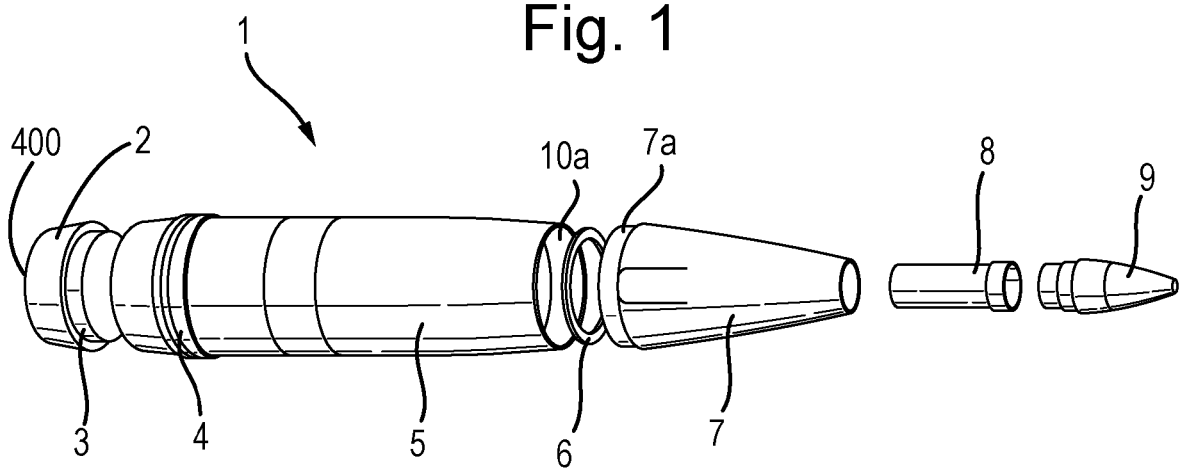
FIG. 1 show an exploded side view of a shell comprising a device according to the invention.
Figure 3:
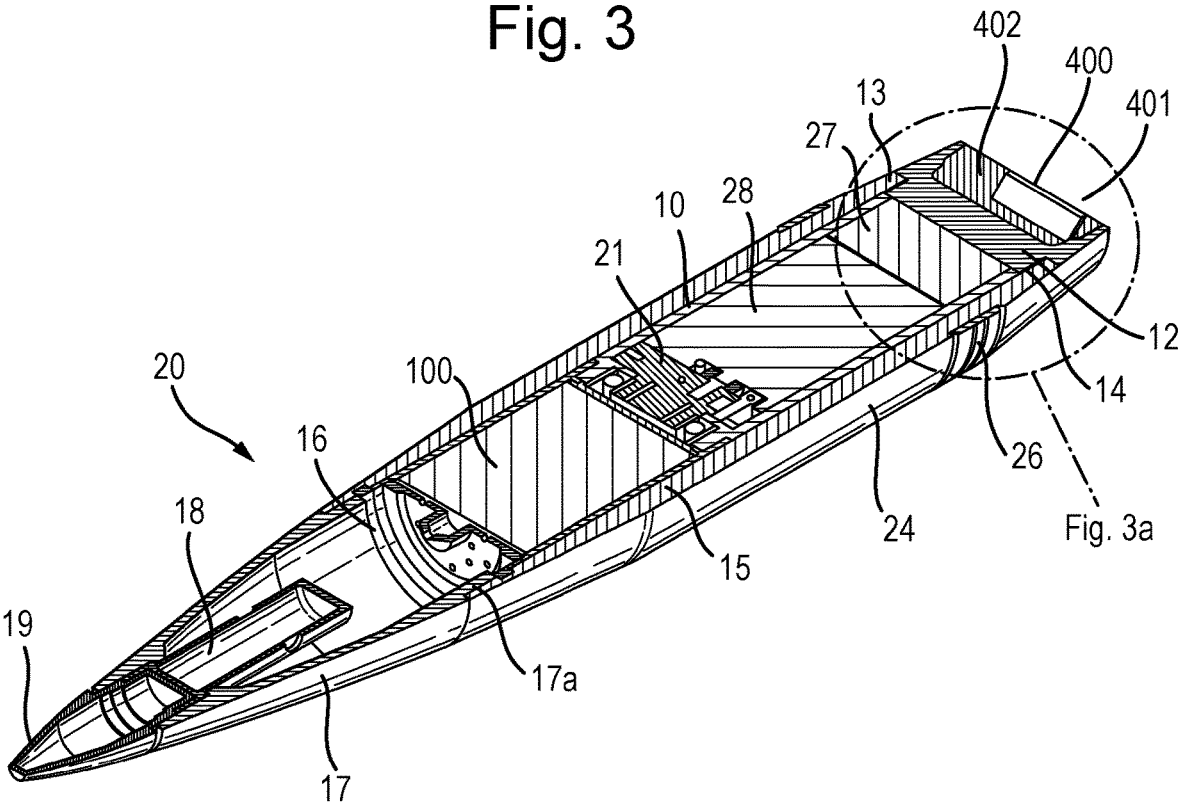
Figure 3A:
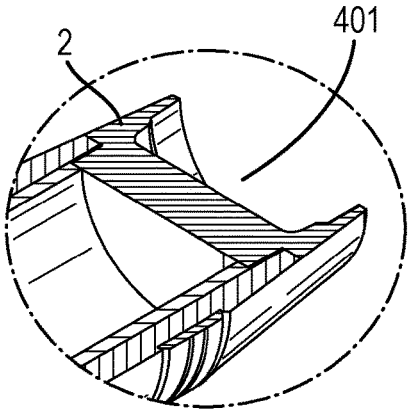

FIGS. 3 and 3*a* shows a cross section along the axis of the shell in FIG. 1

Figure 4:
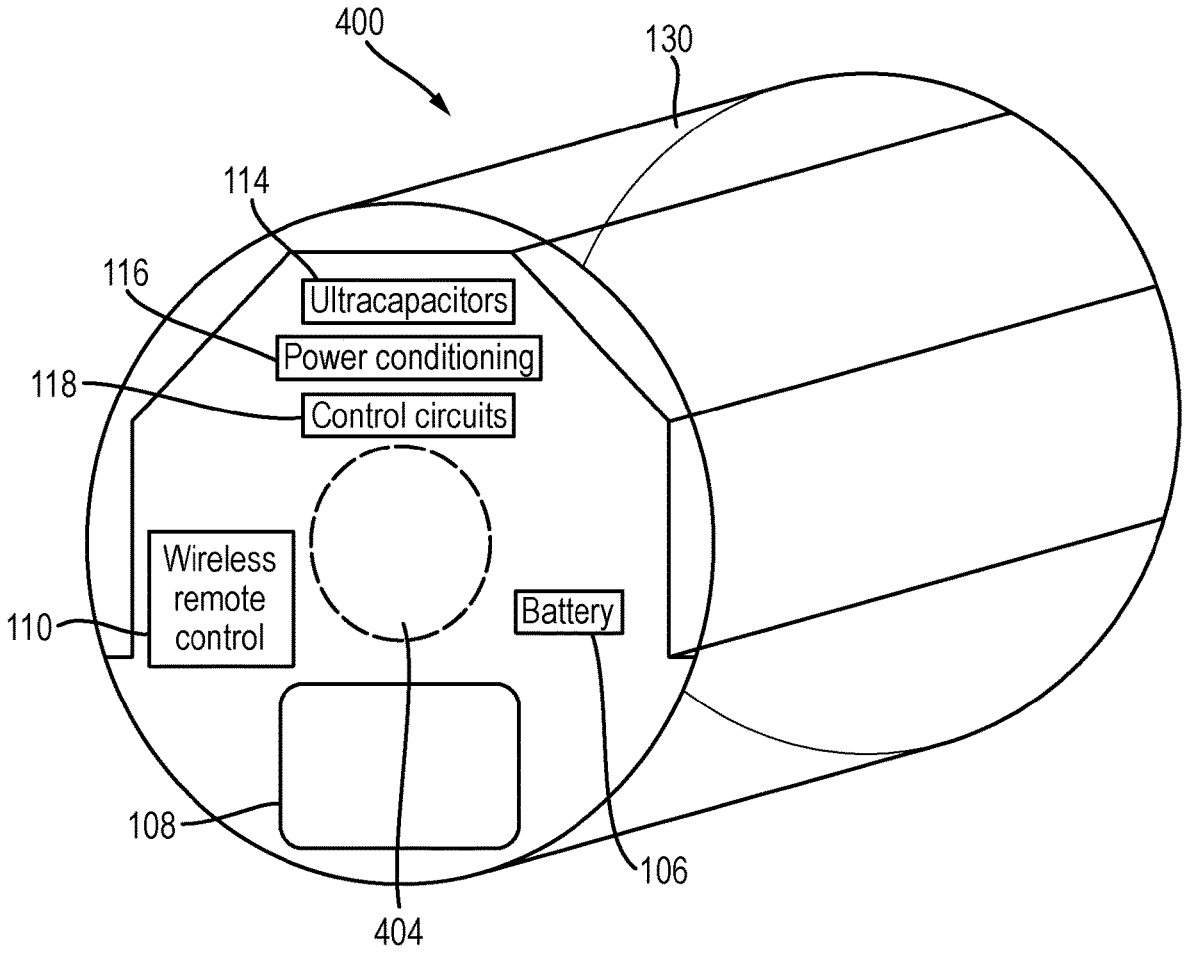
Figure 5:
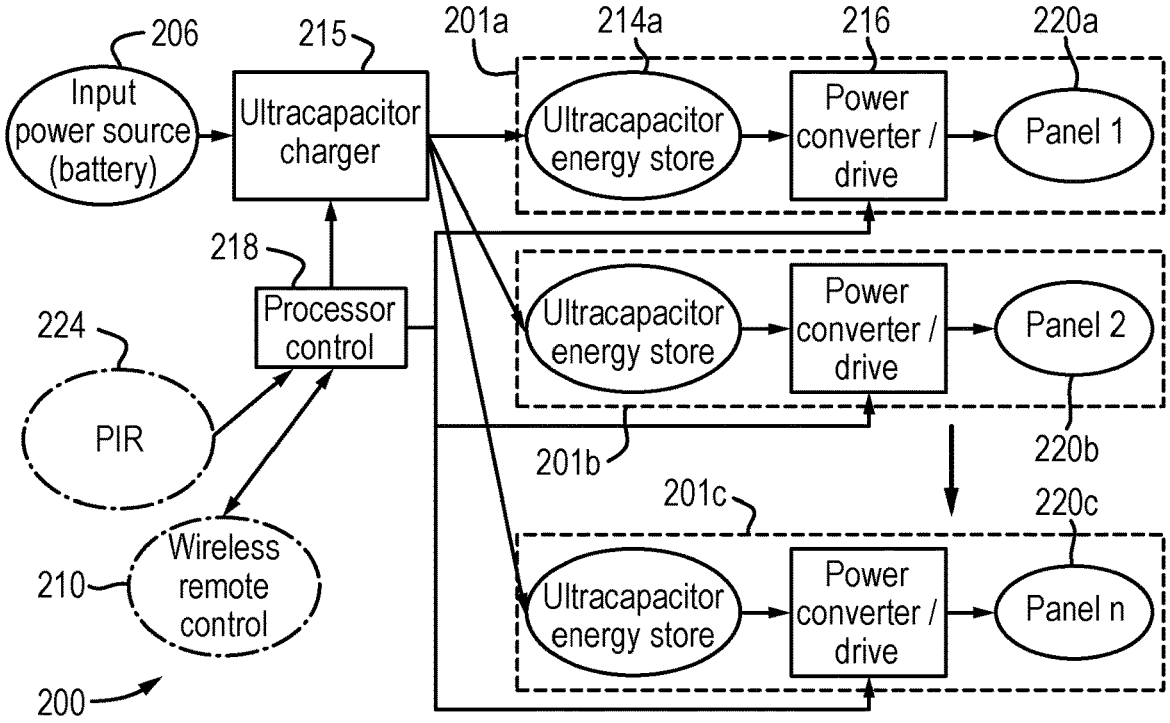
Figure 6:
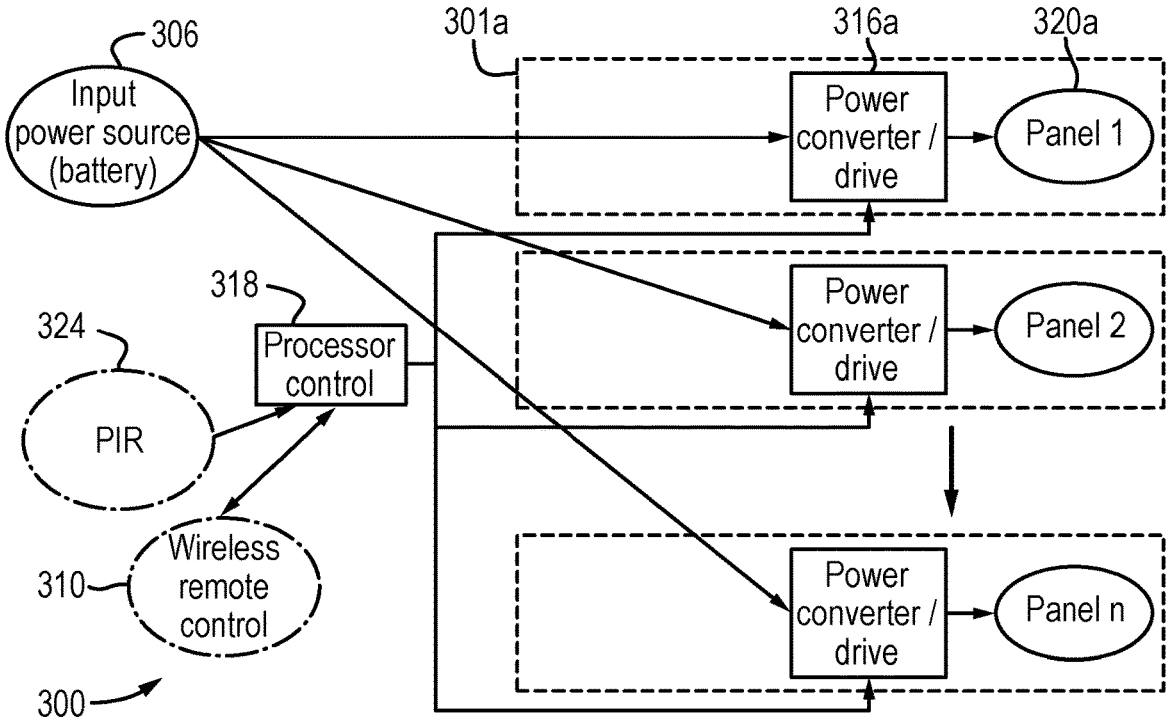
Figure 7:
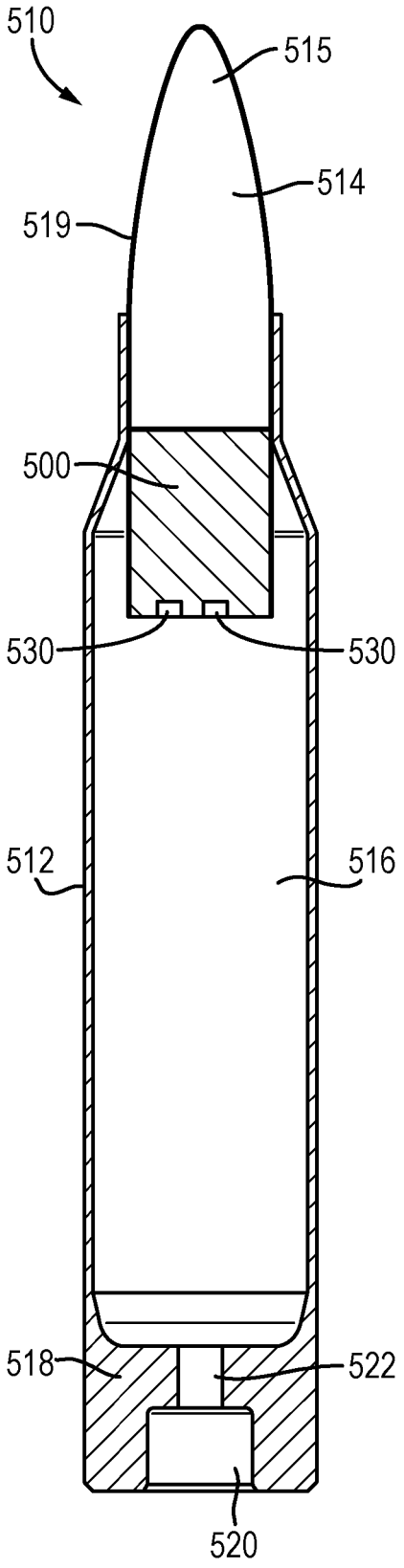
Figure 7A:
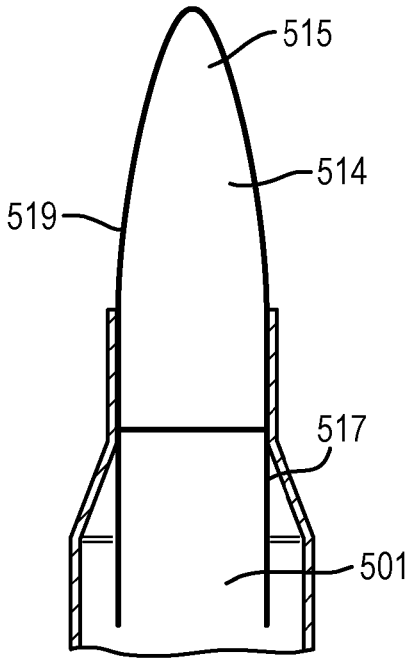

FIG. 4 shows a three-dimensional representation of a device according to the present invention;

FIG. 5 shows a schematic diagram of a first embodiment of a device according to the present invention;

FIG. 6 shows a schematic diagram of a second embodiment of a device according to the present invention;

FIGS. 7 and 7*a* show a tracer bullet, tracer round with an electronic tracer device.

Turning to FIG. 1 there is provided a shell 1, with a main body 5, which is manufactured from a steel alloy. Located around the circumference of the main body 5 is a copper driving band 4, which allows engagement with the rifling on the bore of a barrel, so as to impart spin. A tail unit 2 is located at the aft of the main body 5. The tail unit 2 is made from aluminium and contains a male threaded portion 3, which engages with a reciprocal female threaded portion (not shown) located in the aft of the main body 5. The illumination payload device 100 (see FIG. 2), when located in the payload cavity 10*a*, inside the main body, is retained in place by use of a locking ring 6, which screws into the forward end of main body 5. The frangible ogive element 7 has a frangible link 7*a*, in the form of an aluminium thread. The frangible ogive element 7 may be secured to the locking ring 6 or directly to the main body 5. The frangible ogive element receives the expulsion charge 8 and fuze 9. Upon operation of the fuze 9, the expulsion charge 8 builds up pressure within the frangible ogive element and at the bursting pressure the thread 3 shears and the illumination payload device 100 is expelled from the aft of the main body 5. The tail unit 2, comprises a cavity 401 (see FIG. 3*a*), which faces rearwardly and comprises an electronic tracer device 400. The electronic tracer device 401 is retained by a retainer 402, in the form of a potting compound.

Figure 2:
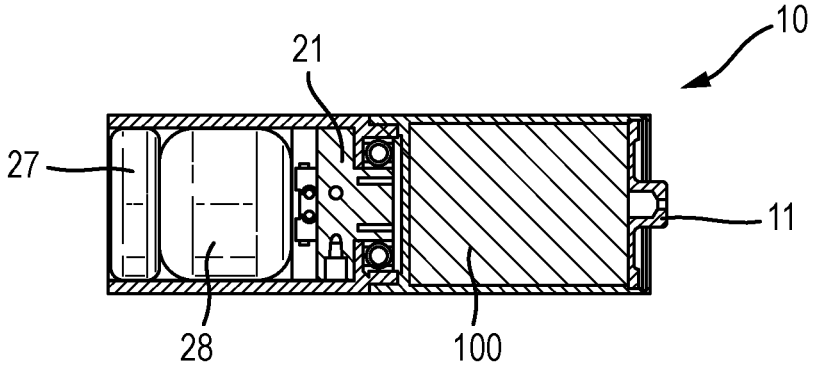
FIG. 2 shows a cross section of the illumination payload device

FIG. 2 shows a modular illumination unit 10, comprising the illumination payload assembly 100, with an electronic switch (or receiver for remote control) 11. The switch after a predetermined period activates the device 29 (shown as 100 in FIG. 6). When the payload 100 is ejected the drogue parachute 27 functions and the parachute delay device 21 causes the main parachute 28 to be deployed.

FIG. 3 shows an illumination shell 20, with a main body 24 formed from a steel alloy, with a driving band 26 located thereupon. A tail unit 12 is located at the aft of the main body 24. The tail unit 12 is made from aluminium and contains a male threaded portion 13, which engages with a reciprocal female threaded portion 14 located at the aft of the main body 24.

The illumination payload device 100 is located in the payload cavity 15, and is retained in place by use of a locking ring 16, which screws into the forward end of main body 24.

The frangible ogive element 17 has a frangible fink 17*a*, in the form of an aluminium thread, which is fastened to the looking ring 16. The frangible ogive element receives the expulsion charge 18 and fuze 19. Upon operation of the fuze 19, the expulsion theme 18 builds up pressure within the frangible ogive element and at the bursting pressure the thread 13 shears and the illumination payload device 100 is expelled from the aft of the main body 24.

The illumination payload device 100 is a modular illumination unit 10, which slides into the payload cavity 15.

With reference to FIG. 4 there is shown generally at 400 electronic tracer device 400. The device 400 comprises a housing 130 which accommodates a an light source in the form of an LED 404. The housing 130 further accommodates a power source 106, an initiation device 108, a transceiver 110 for wireless control of the device, an ultracapacitor 114 (which may be arranged as a plurality of arrays, if there are a plurality of LEDs, especially for larger tracer rounds), a power converter unit 116 (which may be arranged as a plurality of converter units) for driving the LEDs, and a control unit 118.

In operation, the device 400 may be initiated by the launch of the tracer munition. The initiation device 108 will process the stimulus, such as an instruction via the wireless remote control 110, (which may be delivered by a remote control retained by the operator) or a high g force or spin rate of the tracer munition causes the battery 106 to transfer energy, via the power converter units 116 and/or ultracapacitors 114 to the LED 404, which then emit light to illuminate the rear end of the tracer munition to allow its trajectory to be monitored and tracked.

FIG. 5 shows schematically a device 200, similar to device 100, where components similar to components in device 100 are incremented by 100.

With reference to FIG. 5, there is shown a device 200 provided with a plurality of light emission units 201. Each of the light emission units 201 comprises an ultracapacitor array 214, a power converter unit 216 and the LED array 220. The ultracapacitor array 214 is connected to the power converter unit 216 which is in turn connected to the LED array 220.

For instance, a light emission unit 201*a* comprises ultracapacitor array 214*a*, connected to power converter unit 216*a* connected to an LED array 220*a*.

The device 200 is further provided with an ultracapacitor charger 215 connected to each of the arrays of ultracapacitors 214*a*, 214*b* and 214*c*. The ultracapacitor charger 215 is connected to a power source 206 such that the ultracapacitor charger 215 can receive and manage power from the source 206. The ultracapacitor charger 215 is further connected to a control unit 218 such that it may send and receive signals from the control unit 218.

The control unit 218 is additionally connected to each of the power converter units 216*a*, 218*b* and 216*c* such that it can send and receive signals to and from these units.

Still further, the control unit 218 is connected to various interface units, such as a PIR sensor unit 224 and a wireless control unit 210 (which may be provided as part of a broader operator interface including also a manual remote control unit) such that the control unit 218 may act in dependence on signals received from these.

The control unit 218 comprises a signal generator (not shown) and/or clock for generating a periodic signal that varies between an upper value and a lower value at a predetermined frequency.

Each ultracapacitor array 214*a*, 214*b*, and 214*c* is driven by the ultracapacitor charger 215, under instruction from the control unit 218 such that the charging of the ultracapacitor array is regulated such that should the LED array need activation at a predetermined time, the ultracapacitor array is able to discharge through the power converter unit 216 into the LED array 220 (and thereby put the device 200 is a high power output mode) in a predetermined manner.

Accordingly the LED arrays may be switched between a high power mode (i.e. as the ultracapacitor array 214 discharges into the LED array 220) and a low power mode (i.e. as the ultracapacitor array 214 is charged).

FIG. 6 shows schematically a device 300, similar to device 100, where components similar to components in device 100 are incremented by 200.

As such, with reference FIG. 6 there is shown generally at 300 a further schematic embodiment of a device. As compared with the FIG. 5 embodiment, this device 300 tends to do away with the ultracapacitor arrays so 214*a*, 214*b*, 214*c* and the associated charger 215.

Thus in this FIG. 6 embodiment, the light emission units 301 comprise a power converter unit 316 connected to an LED array 320.

A power source 306 is connected to each of the power converters 316*a*, 316*b* and 316*c*. A control unit 318 is connected to each of the power converters 316*a*, 316*b* and 316*c*. The control unit 318 is also connected to various interface units, such as a PIR sensor unit 324 and a wireless control unit 310 (which may be provided as part of a broader operator interface including also a manual remote control unit) such that the control unit 318 may act in dependence on signals received from these.

In operation, the device 300 activates at least one of the LED arrays 320*a*, 320*b*, and 320*c* when the associated power converter unit 316*a*, 316*b*, or 316*c* is instructed by a signal from the control unit 318 to pass electrical energy from the power source 306 to its associated LED array. With energy being transferred from the power source 306 to an LED array 302, the device 300 is placed in a high power mode of operation.

The instruction to pass energy between the power source 306 and some or all of the LED arrays 320*a*, 320*b*, 320*c* may be in the form of a periodic signal having a first phase of a cycle and a second phase of a cycle such that the first phase of the cycle causes activation of the LED arrays 320*a*, 320*b*, 320*c* (i.e. electrical energy is supplied to the LED arrays 320*a*, 320*b*, 320*c*) and the second portion of the cycle causes deactivation (i.e. not electrical energy supplied to the arrays).

Turning to FIGS. 7 and 7*a* The cartridge assembly 510 comprises a casing 512 and a tracer projectile 514. The casing 512 has a hollow section 516 which will contain propellant for displacement of the tracer projectile 514. The casing 512 further comprises a head 518 at the end opposite to the tracer projectile 514 which comprises a chamber 520 for a percussion cap, and a flash tube 522 for communication of an ignition charge from the percussion cap to the inside of the casing 512 and thus the propellant. The walls of the chamber 516 are formed integrally with the head 518. Such a cartridge casing may typically be formed of brass. This material choice has many advantages, for example, it is relatively easy to form into the desired shape. However, brass has demerit in that it is also relatively dense, and hence the casing 512 forms a relatively large percentage of the mass of the whole cartridge. The tracer projectile 514 comprises an outer sheath 519 which comprises inner core 515, and an extended outer sheath portion 517, which is typically drawn past the inner core 514 to create a cavity 501. The cavity is then filled with an electronic tracer device 500. Once the tracer round (bullet) is fired from a gun the electronic tracer device 500 may be initiated either by remote control techniques, or by the physical forces exerted on it by spin or high-g set back. The tracer projectile may be any calibre.

In general operation any of the devices 200 or 300 may be used as follows.

An operator firstly launches or fires the tracer munition.

The operator then selects that the device be activated. This selection may be by means of an instruction to the device issued, via an operator-held remote control device, to the wireless transceiver. Alternatively this instruction may have been made prior to deployment of the device by setting a countdown timer (using a dock in the control unit) such that at the end of the countdown, the device is activated. Alternatively the instruction may be on launch and a physical stimulus such a high-g or high spin rate.

Upon activation the LEDs or laser diodes 530 emit radiation.

The invention claimed is:

1. A tracer bullet for selective activation, the tracer bullet comprising:

an electronic tracer device including an electrical power source and an electronic emitter, whereupon selective activation of the electronic tracer device, said electronic emitter emits radiation;

a cavity capable of receiving said electronic tracer device, such that the electronic tracer device is entirely disposed within the cavity; and an outer sheath and an inner core, wherein the outer sheath extends past an end portion of the inner core to create the cavity between an inner wall of the outer sheath and the end portion of the inner core.

2. The tracer bullet according to claim 1, wherein the electronic emitter includes a light emitting diode or laser diode.

3. The tracer bullet according to claim 1, wherein the radiation emitted by the electronic emitter is in one or both of the visible light spectrum range and infrared radiation (IR) spectrum range.

4. The tracer bullet according to claim 2, wherein the electronic emitter is one of a plurality of light emission units each connected to the electrical power source independently and said light emission units each comprise:

an array including a plurality of light emitting diodes or laser diodes; and a power converter unit for driving the array.

5. The tracer bullet according to claim 4, wherein the array comprises at least two different wavelength light emitting diodes or laser diodes.

6. The tracer bullet according to claim 4, further comprising:

an operator interface, a control unit independently connected to each light emission unit, the control unit comprising a processor and being operably connected to the operator interface.

7. The tracer bullet according to claim 4, wherein each light emission unit comprises a capacitive energy storage, inductive energy storage, kinetic energy storage, electrical cell store, and/or combinations thereof.

8. The tracer bullet according to claim 1, wherein the selective activation comprises an instant initiation or a delayed initiation, and one or both of a wirelessly controlled initiation and a mechanically controlled initiation.

9. The tracer bullet according to claim 1, wherein the cavity is the only cavity on the tracer bullet capable of receiving the electronic tracer device.

10. The tracer bullet according to claim 1, further comprising a retainer, to retain the electronic tracer device within the cavity.

11. The tracer bullet according to claim 1, wherein the cavity faces rearwardly of the tracer bullet.

12. A tracer device in a cavity of a tracer bullet, wherein the tracer bullet comprises an outer sheath and an inner core, wherein the outer sheath extends past an end portion of the inner core to create the cavity between an inner wall of the outer sheath and the end portion of the inner core, and wherein the tracer device comprises: an electrical power source;

and a light emitting diode or laser diode.

13. A method of following the trajectory path of the tracer bullet of claim 1, the method comprising:

firing the tracer bullet;

causing activation of the electronic tracer device; and tracking the spectral output of the electronic emitter.

14. A tracer bullet for selective activation, the tracer bullet comprising:

an electronic tracer device, said tracer bullet containing a cavity capable of receiving said electronic tracer device; and an outer sheath and an inner core, wherein the outer sheath extends past an end portion of the inner core to create the cavity between an inner wall of the outer sheath and the end portion of the inner core, wherein the electronic tracer device is located within the cavity, such that it is flush with or recessed into a tail portion of the tracer bullet, wherein the electronic tracer device comprises an electrical power source and a light emitting diode or laser diode, whereupon selective activation of the electronic tracer device causes said light emitting diode or laser diode to emit light radiation.

15. The tracer bullet according to claim 14, wherein an opening of the cavity faces rearwardly of the tracer bullet.

16. The tracer bullet according to claim 15, wherein the electronic tracer device is retained within the cavity via a potting compound.

17. The tracer bullet according to claim 10, wherein the retainer comprises a potting compound.

18. The tracer device according to claim 12, wherein the light emitting diode or laser diode is configured for deployment within the cavity of the tracer bullet, the cavity facing rearwardly of the tracer bullet.

19. The tracer device according to claim 18, wherein the tracer device is retainable within the cavity via a potting compound.

20. The tracer device according to claim 12, wherein the cavity is the only cavity on the tracer bullet capable of receiving the tracer device.

* * * * *